US007533717B2

(12) United States Patent
Hummel et al.

(10) Patent No.: US 7,533,717 B2
(45) Date of Patent: May 19, 2009

(54) HEAT EXCHANGER, ESPECIALLY OIL COOLER

(75) Inventors: Jürgen Hummel, Bissingen (DE); Eric van Hoof, Rosmalen (NL); Uwe Bindel, Weinstadt (DE)

(73) Assignee: Modine Manufacturing Company, Racine, WI (US)

( * ) Notice: Subject to any disclaimer, the term of this patent is extended or adjusted under 35 U.S.C. 154(b) by 647 days.

(21) Appl. No.: 10/960,326

(22) Filed: Oct. 7, 2004

(65) Prior Publication Data

US 2005/0121182 A1 Jun. 9, 2005

(30) Foreign Application Priority Data

Oct. 10, 2003 (DE) ..... 103 47 181

(51) Int. Cl.
*F28F 3/00* (2006.01)

(52) U.S. Cl. ..... 165/167; 165/79; 165/178; 165/916

(58) Field of Classification Search ..... 165/167, 165/178, 916, 79
See application file for complete search history.

(56) References Cited

U.S. PATENT DOCUMENTS 3,743,011 A * 7/1973 Frost ..... 165/167
4,260,013 A * 4/1981 Sumitomo ..... 165/167
4,360,055 A * 11/1982 Frost ..... 165/167
4,742,866 A * 5/1988 Yamanaka et al. ..... 165/167
4,892,136 A * 1/1990 Ichihara et al. ..... 165/167
4,967,835 A * 11/1990 Lefeber ..... 165/167
5,148,863 A * 9/1992 Fouts et al. ..... 165/153
5,165,468 A * 11/1992 Tajima et al. ..... 165/167
5,558,154 A * 9/1996 Lefeber ..... 165/167
5,797,450 A * 8/1998 Kawabe et al. ..... 165/167
5,810,071 A * 9/1998 Pavlin ..... 165/167
5,927,394 A 7/1999 Mendler et al.
5,964,280 A * 10/1999 Wehrmann et al. ..... 165/167
5,964,283 A 10/1999 Pavlin
6,161,615 A * 12/2000 Brieden et al. ..... 165/167
6,263,962 B1 * 7/2001 Komoda et al. ..... 165/167
6,427,768 B2 * 8/2002 Komoda et al. ..... 165/157
6,595,271 B2 * 7/2003 Komoda ..... 165/167
6,843,311 B2 * 1/2005 Evans et al. ..... 165/167
7,007,749 B2 * 3/2006 Brost et al. ..... 165/167

FOREIGN PATENT DOCUMENTS

DE 197 11 258 A1 9/1998
EP 0 828 980 B1 11/2000

* cited by examiner

*Primary Examiner*—Leonard R Leo
(74) *Attorney, Agent, or Firm*—Michael Best & Friedrich LLP

(57) ABSTRACT

A heat exchanger for cooling oil, including a plurality of pan-shaped heat-transfer plates stacked onto one another to define alternating channels for coolant and oil, a mounting plate soldered on one side to a side of the stacked plates and adapted to mount on its opposite side to a separate component. Openings through the heat-transfer plates and the mounting plate are provided for the passage of the oil and of the coolant, where the openings in the mounting plate have recesses therearound on the side opposite the heat-transfer plates. The recesses are adapted to receive seals therein.

9 Claims, 4 Drawing Sheets

HEAT EXCHANGER, ESPECIALLY OIL COOLER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward heat exchangers, and particularly toward a stacked plate oil cooler.

BACKGROUND OF THE INVENTION AND TECHNICAL PROBLEMS POSED BY THE PRIOR ART

Heat exchangers such as oil coolers built from pan-shaped plates are known from, for example, EP 0 828 980 B1. In such heat exchangers, the plates have bent edges and individual plates are stacked on top of one another with their edges overlapping. The media such as oil to be cooled and coolant are distributed in the heat exchanger through tubes, with the plates defining alternating channels for the two different fluids. The entire oil cooler is often screwed on a housing (e.g., on the housing of a filter using a mounting plate), with a distributor plate integrated between the oil cooler and the mounting plate. Bores are sometimes provided in the distributor plate to distribute both fluids (the coolant and the oil).

Another housingless oil cooler is disclosed in DE 1 97 11 258 C2, which has a reinforcing plate and a base plate for mounting the cooler. In this case, the reinforcing plate is designed as a thickened heat-transfer plate, and the base plate and reinforcing plate are soldered to the oil cooler. The base plate also has a surrounding edge with protruding brackets for securely screwing the oil cooler onto the housing of an engine block, with the connecting pieces for oil and coolant being inserted directly in suitable borings in the housing. The oil cooler is sealed against the engine block housing using seals which sit first on the connecting pieces and are also placed in a groove in the engine block housing. Moreover, the application of a groove in the housing, including the creation of a flat sealing surface on the housing, can lead to some undesirable expenditures.

The present invention is directed toward improving upon the above heat exchangers, including overcoming one or more of the problems set forth above.

SUMMARY OF THE INVENTION

According to an aspect of the present invention, a heat exchanger for cooling oil is provided, including a plurality of pan-shaped heat-transfer plates stacked onto one another to define alternating channels for coolant and oil, a mounting plate soldered on one side to a side of the stacked plates and adapted to mount on its opposite side to a separate component, and openings through the heat-transfer plates and the mounting plate for the passage of the oil and of the coolant, where the openings in the mounting plate have recesses therearound on the side opposite the heat-transfer plates. The recesses are adapted to receive seals therein.

In one form of this aspect of the present invention, the mounting plate is formed from a single metal plate, and the recesses comprise areas on the opposite side of the metal plate from which metal has been removed.

In another form of this aspect of the present invention, the mounting plate is formed from two sheet metal plates secured to one another along adjacent faces. In a further form, both of the metal plates are solder coated on the one side and, in a still further form, impressions are provided in the adjacent face of one of the metal plates around the recesses to provide a solder depot.

In still another form of this aspect of the present invention, the recesses are stamped out from the mounting plate and, in yet another aspect, the openings are stamped out from the mounting plate.

In a further form of this aspect of the present invention, the recesses include first and second recess portions around two of the openings and a slit between the annular recesses. In a further form, the mounting plate is formed from two sheet metal plates secured to one another along adjacent faces with the recess being stamped out of one of the sheet metal plates, and in another form, seals are receivable in the recesses, where each of the seals comprise two annular members receivable in the first and second recess portions and a connecting portion receivable in the recess slit.

In yet another form of this aspect of the present invention, the mounting plate includes bores for fasteners securable to the separate component.

In a still further form of this aspect of the present invention, annular sealing members are received in the recesses and sealing around the openings.

DETAILED DESCRIPTION OF THE INVENTION

Figure 1:
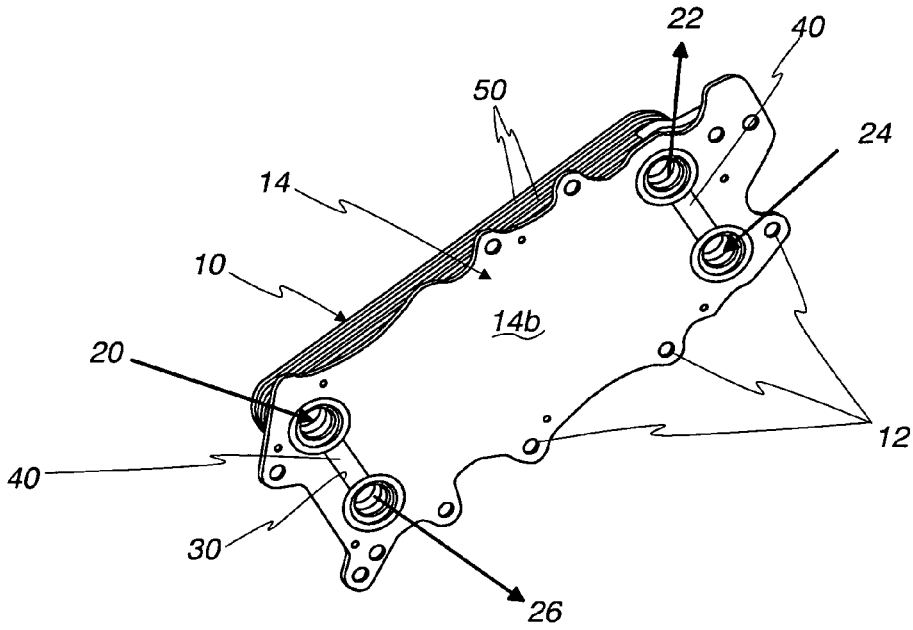
FIG. 1 is a perspective view generally from below an oil cooler embodying the present invention.

FIG. 1 shows a finished soldered oil cooler 10 according to the present invention prior to installation, for example, into a housing or on an engine block. The oil cooler 10 may be suitably mounted, for example, by screws through bores 12 in the cooler mounting plate 14.

The mounting plate 14 may be advantageously formed of two plates, a base plate 14*a* and an outer plate 14*b* of different thickness, with the plates 14*a*, 14*b* soldered together. (As used herein, the terms solder and soldering include braze alloy and brazing.) The plates 14*a*, 14*b* may also have the same external shape such as particularly illustrated in FIGS.

1 and 2. The inner surface 18 of the outer plate 14*b* (which is the side facing away from, e.g., the engine block) may be coated with solder to facilitate securing of the plates 14*a*, 14*b* together.

Openings 20, 22 in the base and outer plates 14*a*, 14*b* allow for oil flow into and out of the oil cooler 10, respectively (as indicated by the arrows). A second set of openings 24, 26 allow for coolant flow into and out of the oil cooler 10, respectively (as also indicated by arrows).

In accordance with the present invention, an advantageous recess 30 in the mounting plate 14 may be defined by stamping an enlarged opening 32 in the outer plate 14*b*. It should also be appreciated, however, that it would be within the scope of the present invention to provide a single mounting plate 14, with the recess 30 suitably produced in the plate 14, for example, by a metal-removing process such as milling.

Figure 3A:
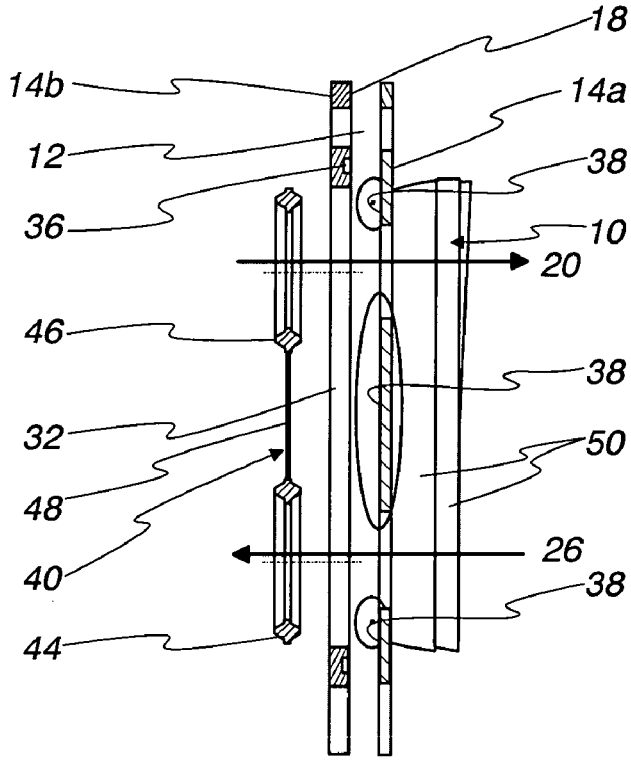
FIG. 3*a* is an exploded cross sectional view taken along line 3-3 of FIG. 2.
Figure 4A:
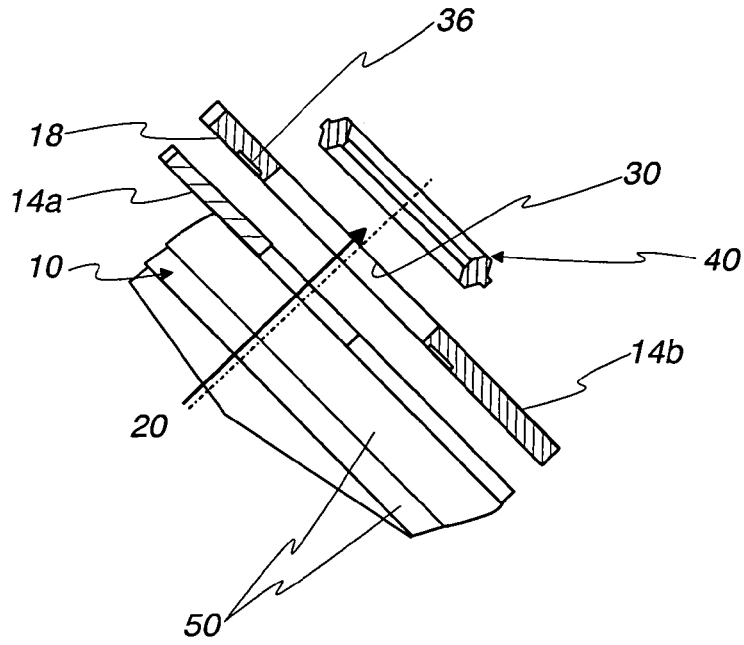
FIG. 4*a* is an exploded cross sectional view taken along line 4-4 of FIG. 2.
Figure 5:
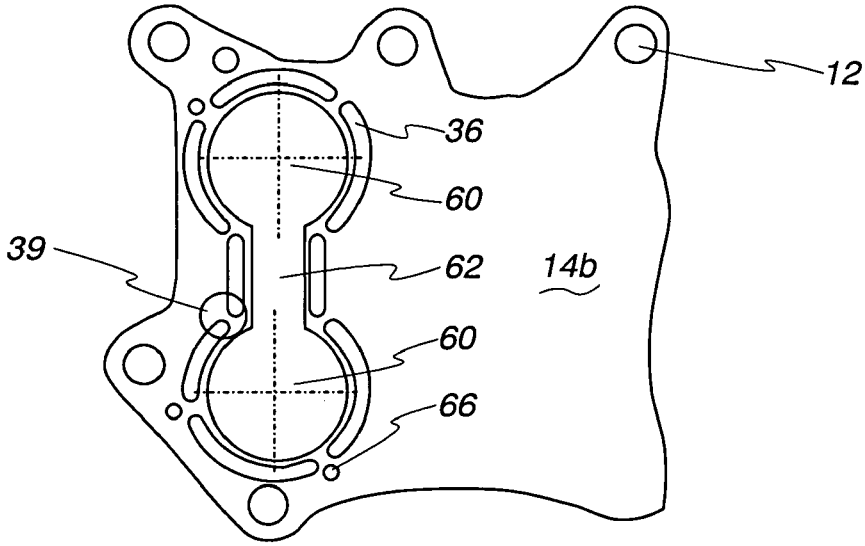
FIG. 5 is a partial plan view of the base plate side of the outer plate of the mounting plate.

As illustrated in FIGS. 3*a*, 4*a*, 5 and 6, impressions 36 may advantageously be provided in the inner surface 18 of the outer plate 14*b* near and around the openings 32 in the outer plate 14*b*. During manufacture of the oil cooler 10, the impressions 36 provide a solder depot for solder from the inner surface 18 of the outer plate 14*b* to prevent solder from flowing during the soldering process onto the sealing surface 38 of base plate 14*a*. The impressions 36 are illustrated in FIG. 5 as having interruptions 39 (see, e.g., FIG. 5), but they can also be made continuous.

Seals 40 may advantageously be mounted in the mounting plate recess 30 in accordance with the present invention. The seals 40 may advantageously include projections 44 (see FIG. 3*a*) formed on their outside to assist in securing the seal 40 in the recess 30 so that it cannot fall out during installation of the oil cooler 10. Further, as best illustrated in FIGS. 4*a*-4*b*, the openings (e.g., 20) in the base plate 14*a* are smaller in cross-section than the corresponding openings in the outer plate 14*b*, so that the seal 40 may be pressed into the recess 30 without risk that it will be pressed too far (e.g., into the oil cooler 10). As a result, a tight bond may be readily achieved between the oil cooler 10 and the component to which it is secured (e.g., the engine block).

Figure 2:
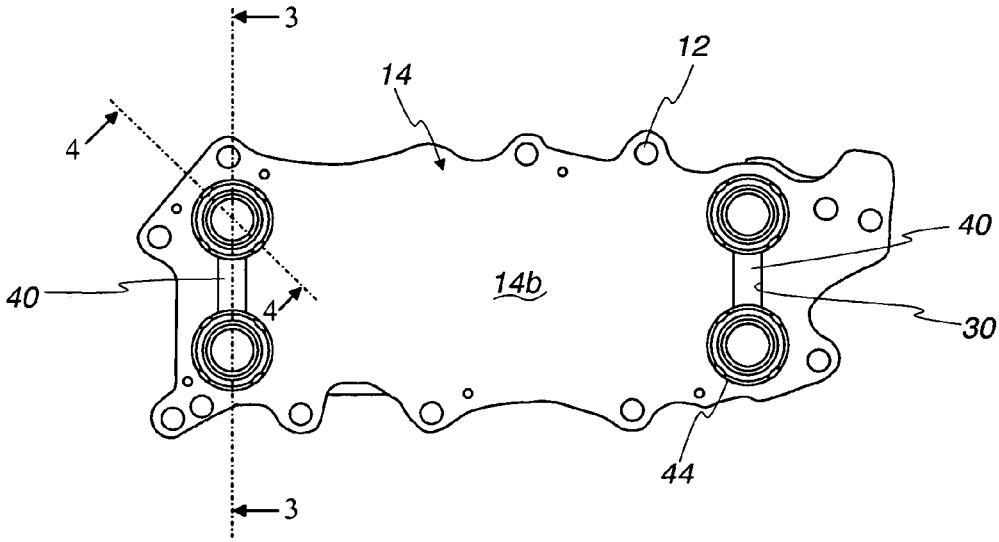
FIG. 2 shows a bottom view of the oil cooler of FIG. 1.
Figure 3B:
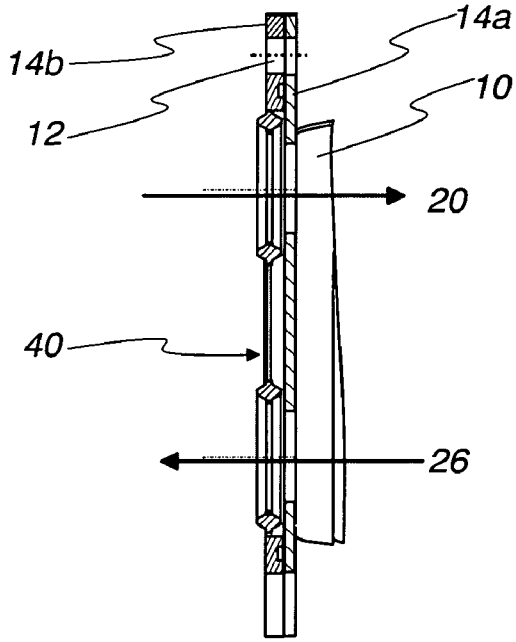
FIG. 3*b* is a non-exploded cross sectional view taken along line 3-3 of FIG. 2.
Figure 4B:
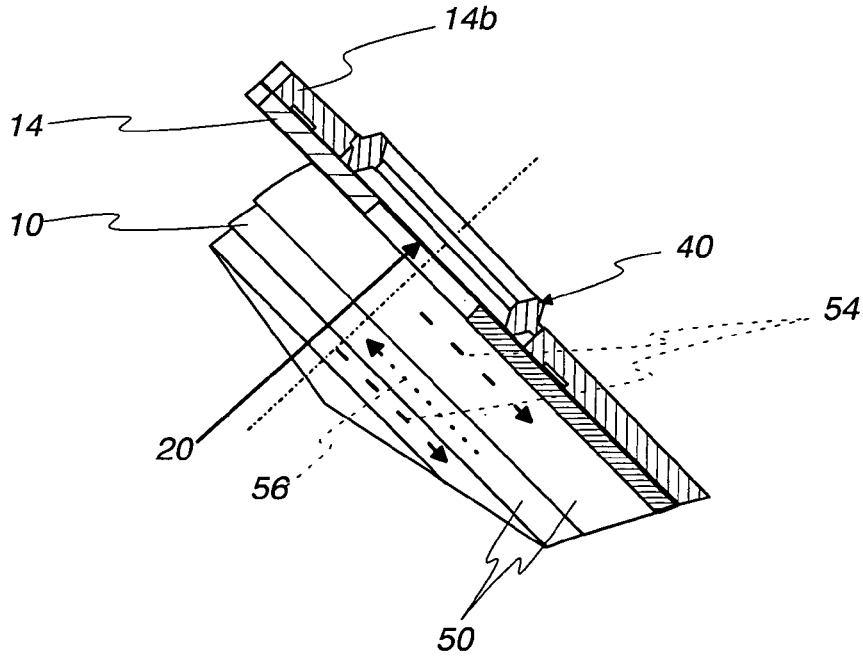
FIG. 4*b* is a non-exploded cross sectional view taken along line 4-4 of FIG. 2.

As illustrated particularly in FIGS. 2, 3*a* and 3*b*, bone-shaped seals 40 may advantageously be used with the present invention. The bone-shaped seal 40 includes a pair of thick, annular beads 46 connected by a thinned middle or connecting member 48. The previously described projections 44 are provided on the beads 46. The recesses 30 are similarly bone-shaped for suitable securing of bone-shaped seals 40 therein. FIG. 3*a* illustrates how such a seal 40 may be placed into the stamped-out recess 30 in the outer plate 14*b*, and FIGS. 3*b* and 5 illustrated the seal 40 in its inserted and seated position. If a single mounting plate 14 is used, the recesses 30 may be composed of two circular recesses and a rectangular recess connecting them.

It should be appreciated, however, that seals of other shapes may also be advantageously used with the present invention in conjunction with different shaped plate recesses. Different shapes may, for example, be desirable based on the position of the openings 20, 22, 24, 26, which themselves are determined by the shape and requirements of the engine block.

FIG. 4*b* illustrates the oil cooler 10 with soldered-on base plate 14*a* and outer plate 14*b* and with inserted seal 40, including channels for the coolant and the oil defined by stacking suitable pan-shaped heat-transfer plates 50. Arrows 54 illustrate exemplary flow paths for oil between the plates 50, and arrow 56 illustrates an exemplary flow path for coolant between the plates 50.

FIG. 5 illustrates the bone shape of the recess 30 advantageously usable with the previously described bone-shaped seal 40. Such a recess 30 includes two circular holes 60 and a slit 62 connecting the holes 60 in the outer plate 14*b*. It will be appreciated that the shape of the seal 40 and the shape of the recess 30 may be advantageously adjusted to accommodate one another according to design requirements.

Bores 66 may be advantageously provided in the plate 14*b* for aeration during the soldering process.

Figure 6:
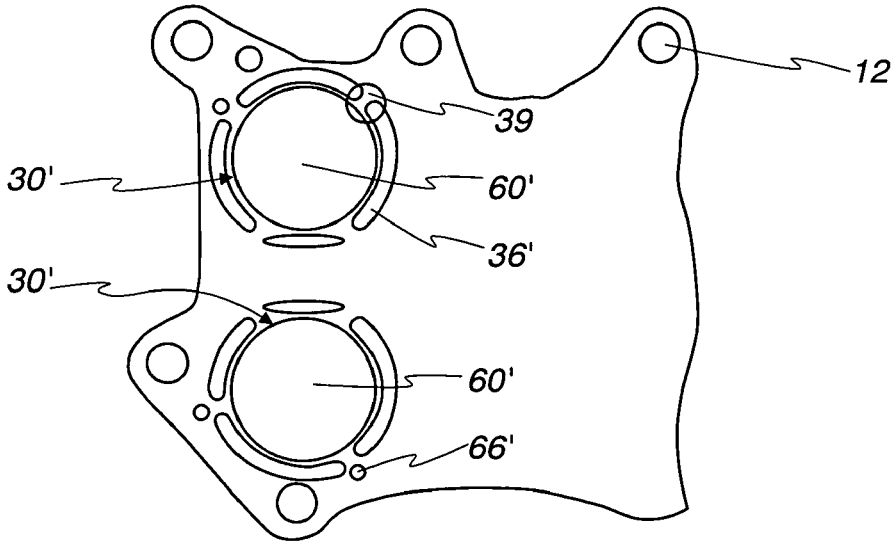
FIG. 6 shows the mounting plate of an alternative embodiment of the present invention in which separate seals are provided at each opening.

FIG. 6 shows an alternative embodiment, in which the recesses 30' consist of separate unconnected circular holes 60', which configuration may be expedient depending on the system requirements. The recesses 30' are larger than the openings (e.g., openings 20, 26) to ensured that the separate annular seals are similarly not undesirably pressed into the oil cooler. The impressions 36' for possible excess solder are arranged around the circular holes 60'. With this embodiment, four individual seals (not shown) are used (one each at the oil inlet and outlet and the coolant inlet and outlet), where each seal may advantageously be a thick annular bead providing a secure sealing function when the oil cooler is installed (e.g., on the engine block).

It should be appreciated that heat exchangers incorporating the above described invention may be reliably and inexpensively manufactured and installed. For example, the recesses 30 on the mounting plate 14 enables the component to which the heat exchanger is mounted (e.g., a housing or engine block) to be manufactured without grooves or similar depressions for seals, thereby simplifying the mounting of the heat exchanger on the component. The two-part design of the combined base plate 14*a* and outer plate 14*b* has additional manufacturing-technological advantages, which lead to a reduction of the manufacturing costs for the heat exchanger, because the recesses can be stamped out. Moreover, in the embodiment with the bone-shaped seals 40, the number of the individual parts being handled during installation is minimized and the insertion of the seal 40 is simplified.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A heat exchanger for cooling oil, comprising:

a plurality of pan-shaped heat-transfer plates stacked onto one another to define alternating channels for coolant and oil;

a mounting plate soldered on one side to a side of the stacked plates, said mounting plate being adapted for mounting on its opposite side to a separate component, said mounting plate being formed from two sheet metal plates secured to one another along adjacent faces, and both of said metal plates being solder coated on said one side;

openings through the heat-transfer plates and the mounting plate defining oil and coolant passages communicating with the alternating channels between the stacked plates, said openings in said mounting plate having recesses therearound on said opposite side adapted to receive seals therein; and impressions in said adjacent face of one of said metal plates, said impressions being around said recesses to provide a solder depot.

2. The heat exchanger of claim 1, wherein said recesses are stamped out from the mounting plate.

3. The heat exchanger of claim 1, wherein said openings are stamped out from the mounting plate.

4. The heat exchanger of claim 1, wherein said mounting plate includes bores for fasteners securable to said separate component.

5. A heat exchanger for cooling oil, comprising:

a plurality of pan-shaped heat-transfer plates stacked onto one another to define alternating channels for coolant and oil;

a mounting plate soldered on one side to a side of the stacked plates, said mounting plate being adapted for mounting on its opposite side to a separate component; and openings through the heat-transfer plates and the mounting plate defining oil and coolant passages communicating with the alternating channels between the stacked plates, said openings in said mounting plate having recesses therearound on said opposite side adapted to receive seals therein, said seals comprising annular sealing members received in said recesses and sealing around said openings, said recesses including first and second recess portions around two of said openings and a slit between said annular recesses.

6. The heat exchanger of claim 5, wherein said mounting plate is formed from two sheet metal plates secured to one another along adjacent faces, and said recess is stamped out of one of said sheet metal plates.

7. The heat exchanger of claim 5, further comprising seals receivable in said recesses, each of said seals comprising two annular members receivable in said first and second recess portions and a connecting portion receivable in said recess slit.

8. The heat exchanger of claim 7, wherein said mounting plate is formed from two sheet metal plates secured to one another along adjacent faces.

9. The heat exchanger of claim 8, wherein both of said metal plates are solder coated on said one side.

* * * * *